US005301888A

United States Patent [19]

Danzi

[11] Patent Number: 5,301,888

[45] Date of Patent: Apr. 12, 1994

[54] STORAGE UNIT AND DISPENSER FOR PAPER PRODUCT ROLLS

[76] Inventor: Anthony F. Danzi, 23 Jason Ct., Colonia, N.J. 07067

[21] Appl. No.: 82,345

[22] Filed: Jun. 24, 1993

Related U.S. Application Data

[63] Continuation of Ser. No. 801,946, Dec. 3, 1991, abandoned.

[51] Int. Cl.[5] ..... A47K 10/22

[52] U.S. Cl. ..... 242/55.2; 312/34.22; D6/523

[58] Field of Search ..... 242/55.2, 55.3, 55.42, 242/55.53, 55.54; 206/394; 312/34.22, 34.8; D6/518, 520, 521, 523

[56] References Cited

U.S. PATENT DOCUMENTS

| | | | |
|---|---|---|---|
| 2,459,252 | 1/1949 | Strham | 242/55.53 |
| 2,534,290 | 12/1950 | Moskowitz | 206/56 |
| 2,564,539 | 8/1951 | Lucan | 242/55.3 |
| 3,245,626 | 4/1966 | Casteel | 242/55.54 |
| 3,275,133 | 9/1966 | Wood | 206/394 |
| 3,316,040 | 4/1967 | McGann | 242/55.53 |
| 3,374,042 | 3/1968 | Smith | 242/55.53 |
| 3,421,800 | 1/1969 | Brown | 242/55.53 |
| 3,738,721 | 6/1973 | Maschek et al. | 242/55.3 |
| 4,124,259 | 11/1978 | Harris | 242/55.53 |
| 4,177,958 | 12/1979 | Poole | 242/55.42 |
| 4,273,392 | 6/1981 | Stinson | 312/42 |
| 4,294,389 | 10/1981 | Falk et al. | 242/55.3 |
| 4,432,451 | 2/1984 | Hooser | 206/216 |
| 4,607,809 | 8/1986 | Sineni | 242/55.3 |
| 4,765,475 | 8/1988 | Kaysserian | 206/394 |
| 4,898,335 | 2/1990 | Eysink | 242/55.42 |

*Primary Examiner*—Daniel P. Stodola
*Assistant Examiner*—John Q. Nguyen
*Attorney, Agent, or Firm*—Lerner, David, Littenberg, Krumholz & Mentlik

[57] ABSTRACT

A storage unit and dispenser for paper product rolls is disclosed having a hollow, elongate body with an open head end and a closed base, adapted to stand upright on the base; an elongated insert adapted to support vertically a plurality of paper product rolls stacked in end-to-end relation, with the insert being receivable within the body in telescoping relationship therewith and having a top member and a bottom member, with the top member having an upper surface and a lower surface, the bottom member having a cross-sectional dimension less than the cross-sectional dimension of the body and being adapted to support a plurality of rolls in vertically stacked relationship, and the insert being formed with an opening dimension to permit lateral removal of at least one of the vertically stacked rolls; and a holder for horizontally dispensing a paper product roll, which holder is affixed to the upper surface of the top member.

7 Claims, 3 Drawing Sheets

STORAGE UNIT AND DISPENSER FOR PAPER PRODUCT ROLLS

This is a continuation of application Ser. No. 07,801,946 filed Dec. 3, 1991, now abandoned.

BACKGROUND OF THE INVENTION

The present invention relates to a combination storage unit and dispenser for paper product rolls, such as toilet tissue. In particular, the present invention combines a storage unit in which a plurality of paper product rolls are vertically stacked in end-to-end relationship, with a holder mounted atop the storage unit for horizontal dispensing of a roll of the paper product that is actively in use.

Many homes have bathrooms and "half-baths" lacking a convenient place to mount a wall fixture for dispensing toilet tissue, or a place within reach of the toilet for concealed storage of spare rolls of toilet tissue. A need exists for free-standing devices capable of dispensing a roll of toilet tissue actively in use and attractively storing spare rolls of toilet tissue.

Devices are known that combine a dispenser for a roll of a paper product with a storage unit for a plurality of paper product rolls. U.S. Pat. No. 2,564,539 to Lucan discloses a horizontal dispenser for a paper product roll with a storage unit that vertically stacks spare rolls in end-to-end relationship. The stored rolls, however, are not readily accessible.

U.S. Pat. No. 4,124,259 to Harris discloses a horizontal dispenser for a paper product roll mounted atop a cabinet. The paper product rolls are not necessarily vertically stacked, and the cabinet need not be used exclusively for this purpose, and may therefore become cluttered with the paper product rolls and other bathroom items, thereby hindering the accessibility of the rolls. U.S. Pat. No. 4,177,958 to Poole discloses a vertical dispenser for a roll of a paper product with a storage unit that vertically stacks the paper product rolls in end-to-end relationship. The tissue web is dispensed through a vertical slit in the cover of the vertical dispenser. Tearing and threading of the web through the slit is problematic.

The storage of plural rolls of paper products in vertical stacks of rolls in end-to-end relationship is also disclosed in U.S. Pat. No. 2,534,290 to Moskowitz, U.S. Pat. No. 3,275,133 to Wood, U.S. Pat. No. 3,316,040 to McGann, U.S. Pat. No. 4,273,392 to Stinson, U.S. Pat. No. 4,432,451 to Hooser, U.S. Pat. No. 4,607,809 to Sineni, U.S. Pat. No. 4,765,475 to Kaysserin and U.S. Pat. No. 4,898,335 to Eysink. None of these storage units are combined with a horizontal dispenser for a paper product roll actively in use.

A need remains for a combination storage unit and dispenser for paper product rolls in which the paper product roll actively in use is horizontally dispensed and the spare rolls are accessibly stored in proximity to the dispenser.

SUMMARY OF THE INVENTION

This need is met by the present invention, which mounts a horizontal dispenser for a paper product roll atop a storage unit that conceals plural rolls of the paper product that are vertically stacked in end-to-end relationship. The storage unit is a pedestal having a telescoping insert within which the spare paper product rolls are stacked and concealed. The pedestal thus conceals the spare paper product rolls until the insert is telescoped, at which time the spare rolls can be conveniently accessed. The roll dispenser is mounted on top of the insert, thereby maintaining the dispenser and the spare rolls in close proximity in a combination that can be readily positioned at locations convenient to the use of the rolled paper product. When the rolled paper product is toilet tissue, the device of the present invention may be positioned at locations convenient to the bathroom toilet.

Therefore, in accordance with the present invention, there is provided a storage unit and dispenser for paper product rolls having a hollow, elongated body with an open head end and a closed base, adapted to stand upright on the base; an elongated insert adapted to support a plurality of paper product rolls vertically stacked in end-to-end relation, which insert is receivable within the body in telescoping relationship therewith and has a top member and a bottom member, with the top member having an upper surface and a lower surface, the bottom member having a cross-sectional dimension less than the cross-sectional dimension of the body and being adapted to support a plurality of rolls in vertically stacked relationship, and the insert being formed with an opening dimension to permit lateral removal of at least one of the vertically stacked rolls; and a holding means for horizontal dispensing of a paper product roll affixed to the upper surface of the top member. Preferably, the body is a cylindrical body and the insert is a tubular insert with a semi-circular wall interconnecting the top member and the bottom member and an insert opening that is an arcuate cross-sectional opening of the insert extending from the top member to the bottom member.

As will be readily appreciated, the device of the present invention provides a combination of a storage unit and dispenser for paper product rolls that maintains the active roll and spare rolls in close proximity in an assembly that can be placed in convenient locations. The device conceals the spare rolls to avoid the appearance of clutter, yet the rolls are readily accessible to the dispenser when needed. Furthermore, the device of the present invention, while being highly utilitarian in function, is readily adaptable to a variety of aesthetically pleasing design, which is a particularly important criterion for an article to be used in the home.

DETAILED DESCRIPTION OF THE PREFERRED EMBODIMENT

Figure 1:
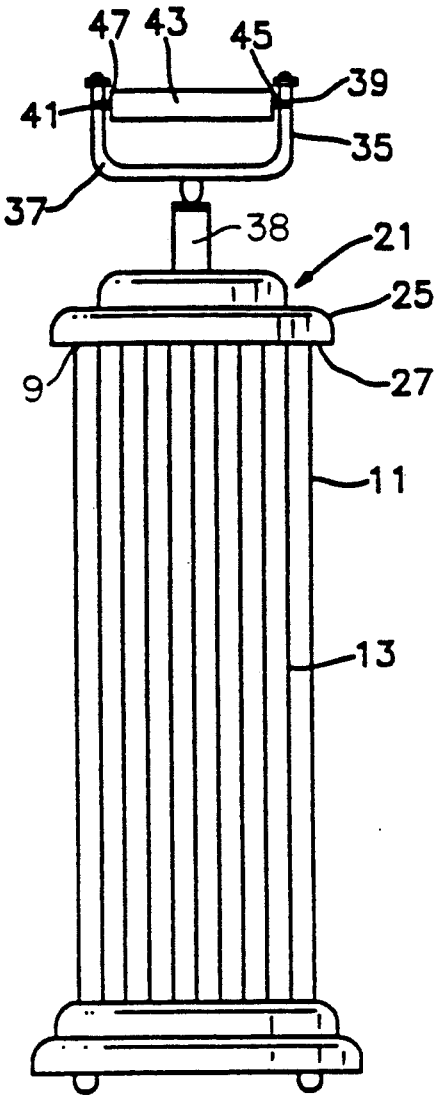
FIG. 1 is a front elevational view of one embodiment of the storage unit and dispenser of the present invention.
Figure 2:
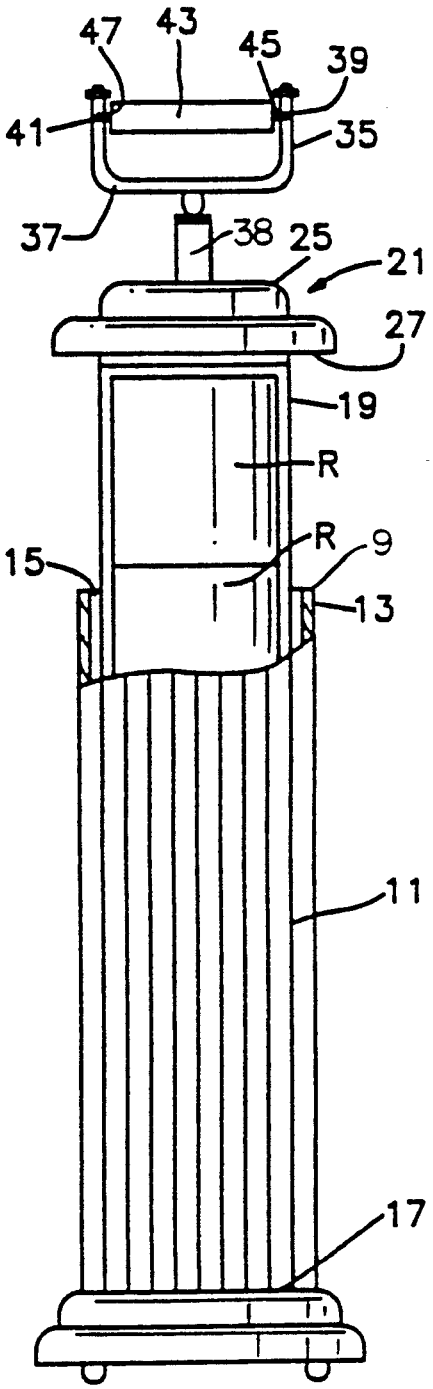
FIG. 2 is an expanded front elevational view of the storage unit and dispenser of FIG. 1.
Figure 3:
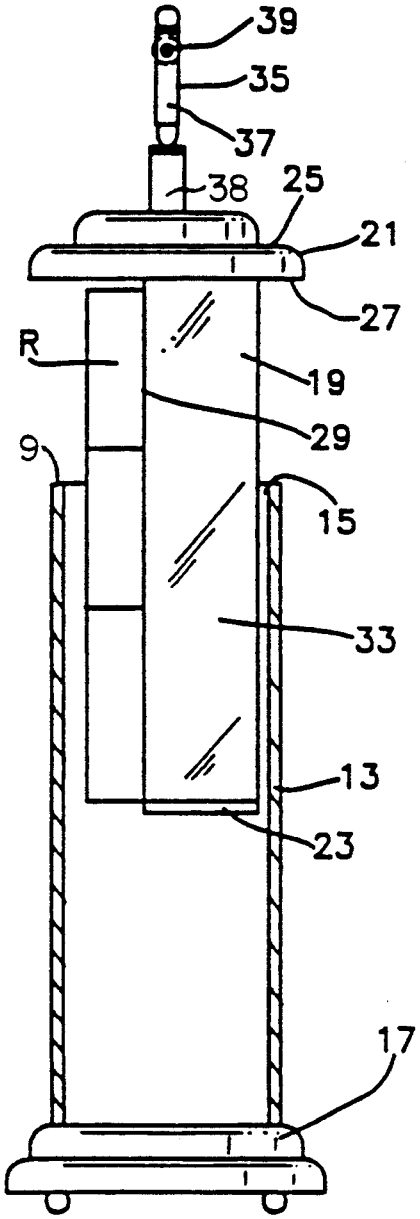
FIG. 3 is an expanded side elevational view of the storage unit and dispenser of FIG. 1.
Figure 4:
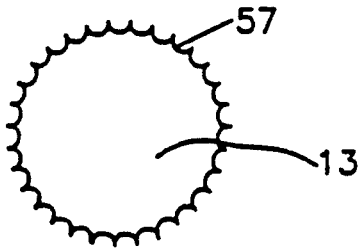
FIG. 4 is a top view of one embodiment of the body of the dispenser of FIG. 1.

Referring to FIGS. 1-3, the pedestal storage unit 11 of the device of the present invention includes a hollow, elongated body 13. As shown in FIG. 2, elongated body 13 has an open head end 15 and a closed base 17, which body is adapted to stand upright on the base. An elongated insert 19, adapted to vertically support a plurality of the paper product rolls R stacked end-to-end is receivable within the body 13 in telescoping relationship therewith. In the depicted embodiment, the body 13 and insert 19 are cylindrical, or tubular, in form.

The insert 19 has a top member 21 with an upper surface 25 and a lower surface 27. As shown in FIGS. 1 and 2, the open head end 15 of body 13 has an upper edge 9, and top member 21 has a cross-sectional dimension of body 13 so that the lower surface 27 of top member 21 engages the upper edge 9 of body 13, thereby supporting insert 19 in body 13. In this manner, the top member 21 functions as a cover for the open head end 15 of body 13.

Alternatively, the top member can function as a cover for the open head end of the body by having a cross-sectional diameter less than the body so that the insert is supported by its bottom member resting on the base of the body. Depending upon the length of the insert, the upper surface of the top member will either be recessed within, flush with or raised from the upper edge of the body.

Referring to FIG. 3, insert 19 has a bottom member 23 with a cross-sectional dimension less than the cross-sectional dimension of body 13, but greater than the diameter of paper product roll R. The bottom member 23 is adapted to support a plurality of rolls in vertically stacked relationship.

Insert 19 is formed with an opening 29 dimensioned to permit lateral removal of at least one of the vertically stacked rolls R. In the depicted embodiment, the insert 19 has a semi-circular wall 33 interconnecting top member 21 and bottom member 23 and arcuate cross-sectional opening 29 extending from top member 21 and bottom member 23.

The dispenser 35 for a paper product roll R is then affixed to the upper surface 25 of top member 21. In the depicted embodiment, the dispenser 35, includes a bracket 37 having apertures 39 and 41 in which roller 43 having projections 45 and 47 is rotatably and horizontally mounted. In the depicted embodiment, the bracket 37 projects upwardly atop handle 38 from the upper surface 25 of top member 21. The roller 43 is adapted to receive the core (not shown) of paper product roll R.

Figure 5:
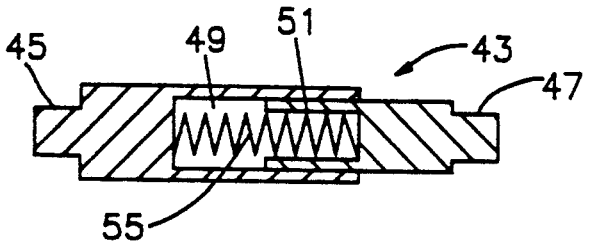
FIG. 5 is a sectional view in side elevation of the dispenser roller of FIG. 1.

As shown in FIG. 5, the roller 43 has shaftway 49 adapted to receive hollow shaft 51 glidably mounted in shaftway 49. A spring 55 is positioned in shaftway 49 and hollow 53 of shaft 51 and urges roller 43 and shaft 51 away from each other in axial directions. The spring 55, and thus, the roller 43, can be compressed to permit the roller projections 45 and 47 to be inserted into or removed from apertures 39 and 41, thereby permitting the replacement of a paper product roll R mounted on roller 43.

Figure 6:
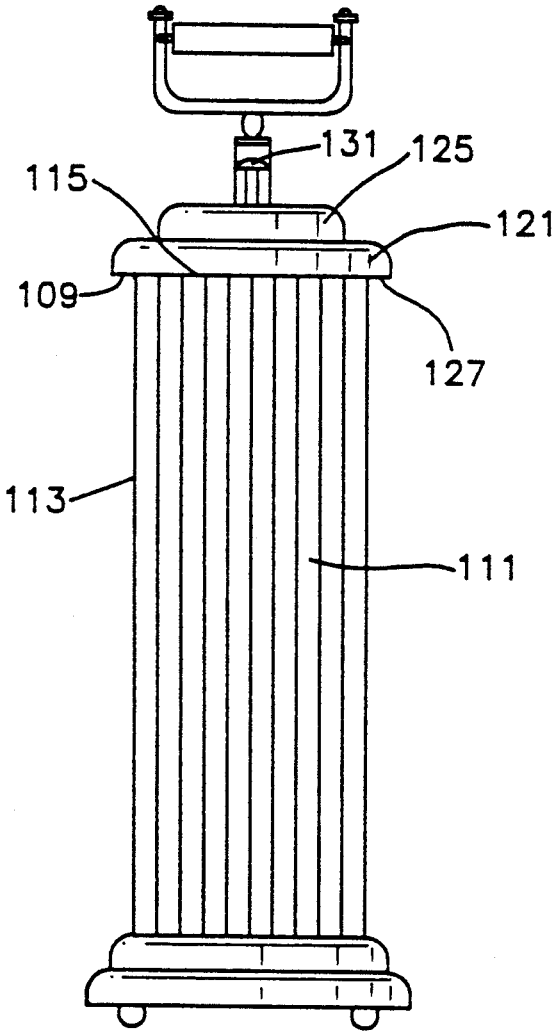
FIG. 6 is a front elevational view of another embodiment of the storage unit and dispenser.

Access to the insert 19 is thus obtained by lifting up on bracket 37 by handle 38, which telescopes insert 19 from body 13 of pedestal 11. Alternatively, as shown in FIG. 6, handle 131 can be attached to top member 121, in this embodiment depicted on the upper surface 125 of top member 121. By lifting up on handle 131, the insert (not shown) is telescoped from body 113 of pedestal 111.

Referring to FIG. 1, to store rolls of paper products in the device of the present invention, bracket 37 is lifted to telescope insert 19 from body 13. Paper rolls R are inserted through the opening 29 of insert 19 and positioned so that they are supported by bottom member 23. When needed, the spare rolls are retrieved by again telescoping the insert 19 from body 13 by lifting on bracket 37 by handle 38. A spare paper product roll R is then removed from the insert 19 through opening 29 and the insert 19 is then telescoped back into body 13.

Figure 7:
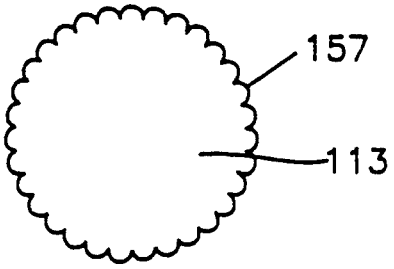
FIG. 7 is a top view of the body of the dispenser of FIG. 6.

The device of the present invention can be easily fabricated from materials commonly used in the manufacture of accessories for the home, which materials are also capable of being fashioned into ascetically pleasing designs. Such materials include plastic, wood, metal, cast plaster, ceramic, and the like. The embodiments of FIG. 1–4 are fabricated from plastic and feature a border 57 of concave scallop design, shown in the top view perspective of body 13 of FIG. 4. The body 113 of the embodiment of FIG. 6 is fabricated from wood and features a border 157 of convex scallops, shown in top view perspective in FIG. 7. While both concave and convex scallops can be fabricated from wood or plastic, it is simpler to fashion the concave scallops from plastic and the convex scallops from wood.

Thus, it can be appreciated, that the device of the present invention provides an aesthetically pleasing combination of a storage unit and dispenser for paper product rolls that conceals a spare supply of rolls in close proximity to the active roll dispenser in an assembly that can be readily placed in convenient locations. As will be readily appreciated, numerous variations and combinations of the features set forth above can be utilized without departing from the present invention as set forth in the claims. Such variations are not regarded as a departure from the spirit and scope of the invention, and all such modifications are intended to be included within the scope of the following claims.

What I claim is:

1. A device for storing and dispensing paper product rolls, said device comprising:

a hollow, elongate body having an open head end and a closed base, adapted to stand upright on said base;

an elongated insert adapted to support vertically a plurality of said paper product rolls stacked in end-to-end relation, said insert being receivable within said body in telescoping relationship therewith and comprising a top member connected to a bottom member, said top member having an upper surface and a lower surface, said bottom member having a cross-sectional dimension smaller than the cross-sectional dimension of said body and being adapted to support a plurality of rolls in vertically stacked relationship, and said bottom member being formed with an opening dimensioned to permit lateral removal of at least one of said vertically stacked rolls;

a handle affixed to said upper surface of said top member and projecting a predetermined distance therefrom;

a means for dispensing a paper product roll horizontally and rotatably disposed on a mounting means projecting upwardly from said handle for mounting said dispensing means to said handle in spaced relation.

2. The device of claim 1, wherein said body is cylindrical.

3. The device of claim 1, wherein said insert is tubular in form.

4. The device of claim 3, wherein said tubular insert has a semi-circular wall interconnecting said top member and said bottom member.

5. The device of claim 3, wherein said opening of said tubular insert comprises an arcuate cross-sectional opening.

6. The device of claim 5, wherein said arcuate cross-sectional opening extends from said top member to said bottom member.

7. The device of claim 1, wherein said open head end of said body has an upper edge and said top member has a cross-sectional dimension greater than said cross-sectional dimension of said body, so that said lower surface of said top member engages said upper edge of said body, thereby supporting said insert in said body.

* * * * *